US005421257A

United States Patent [19]

Okuda et al.

[11] Patent Number: 5,421,257

[45] Date of Patent: Jun. 6, 1995

[54] SHEET TRANSFERRING MACHINE FOR PRINTING MACHINE

[76] Inventors: Masaharu Okuda, 815, Hiromi, Seki-shi, Gifu-ken 501-32; Haruki Umemura, 2453, Oyada, Mino-shi, Gifu-ken 501-37, both of Japan

[21] Appl. No.: 253,409

[22] Filed: Jun. 3, 1994

Related U.S. Application Data

[63] Continuation-in-part of Ser. No. 237,684, May 4, 1994.

[30] Foreign Application Priority Data

Dec. 2, 1993 [JP] Japan ..... 5-303123

[51] Int. Cl.[6] ..... B41F 7/06

[52] U.S. Cl. ..... 101/137; 101/142; 101/232; 101/218; 271/82

[58] Field of Search ..... 101/137, 142, 144, 232, 101/247, 183, 216, 217, 218, 230, 177, 410; 271/82

[56] References Cited

U.S. PATENT DOCUMENTS

| | | | |
|---|---|---|---|
| 3,937,142 | 2/1976 | Cerny et al. | 101/232 |
| 5,125,336 | 6/1992 | German | 101/137 |
| 5,136,946 | 8/1992 | Becker | 101/247 |
| 5,335,597 | 8/1994 | Helmstädter | 101/142 |

*Primary Examiner*—Eugene H. Eickholt
*Attorney, Agent, or Firm*—Vidas, Arrett & Steinkraus

[57] ABSTRACT

An apparatus for transferring a sheet between a plurality of printing units is disclosed. A transfer cylinder is provided between the adjacent units and is rotated by a motor. A drive gear mechanically connected to the motor and a driven gear mechanically connected to the transfer cylinder mate with each other. The press on a single surface and on both surfaces of the sheet are selectively performed, and a phase between the gears is adjusted by a phase adjusting mechanism. Stoppers are formed with the drive gear and driven gear respectively, for stopping relative rotation between the gears.

16 Claims, 14 Drawing Sheets

SHEET TRANSFERRING MACHINE FOR PRINTING MACHINE

CROSS REFERENCE TO RELATED APPLICATION

This application is a continuation in part application of the U.S. application Ser. No. 08/237,684, filed on May 4, 1994, entitled SHEET TRANSFERRING APPARATUS FOR PRINTING MACHINE which is herein incorporated by reference.

BACKGROUND OF THE INVENTION

1. Field of the Invention

The present invention relates to a sheet-fed printer employed for an offset press, more particularly to a sheet transferring mechanism which transfers a sheet between a plurality of printing units so as to perform multiple color press on a single surface of the sheet and a single color press on both surfaces of the sheets.

2. Description of the Related Art

Printed matters such as pamphlets and catalogs are mostly printed using offset presses. The offset press is capable of multi-color printing and also well suited for mass printing. Sheet-fed printers, to which printing paper sheets of the same size are fed one by one to carry out printing, are widely employed in such offset press. In a mode where printing is to be applied on both surfaces of the sheet (double-side printing) is to be carried out in such type of sheet-fed printer, the sheet must be reversed and transferred.

As shown in FIGS. 13(*a*) and (*b*), the offset press is provided with a feed cylinder 100 and a transfer cylinder 101, with a supply cylinder 102 being disposed between and adjacent to these cylinders 100 and 101. The supply cylinder 102 has a diameter twice as great as those of the other cylinders 100,101. The printing sheet Pa subjected to a first printing is forwarded from the impression cylinder (not shown) to the feed cylinder 100 with the printed surface facing toward the cylinder 100.

Subsequently, the sheet Pa retained on the transfer cylinder 100 is grasped at its front edge by the grippers of the supply cylinder 102 and shifted to the outer surface thereof. The sheet Pa is retained on the supply cylinder 102 with the printing surface facing outward.

In a mode where printing is to be applied on a single surface with two colors (single-side printing) is to be carried out, as shown in FIG. 13(*a*), the front edge of the printing sheet Pa retained on the supply cylinder 102 is grasped by a plurality of holders 103 arranged in the axial direction of the transfer cylinder 101. The sheet is reversed and then fed to the transfer cylinder 101 with the printed surface facing inward. Meanwhile, when the printing sheet Pa is to be printed on both sides thereof, the rear edge of the printing sheet Pa retained on the supply cylinder 102 with the printed surface facing outward is grasped by the holders 103 and fed to the transfer cylinder 101 in the same posture, as shown in FIG. 13(*b*).

Accordingly, when the printing mode is switched from single-side printing to the double-side printing, the holders 103 of the transfer cylinder 101 must grasp the rear edge of the printing sheet Pa. Thus, when another printing sheet Pa having a different size is used, the phase of the transfer cylinder 101 relative to the supply cylinder 102 must be adjusted so as to allow the holders 103 to securely grasp the sheet Pa.

The phase adjustment of the reversing mechanism at switching between single-side printing and double-side printing has conventionally been carried out by changing the phase of the input gear 104 and that of the output gear 105, which transmit the driving force of the main motor, as shown in FIG. 14. Namely, the bolts 106 fastening the input gear 104 are loosened to turn the input gear 104 according to the scale. The phase of the input gear 104 is adjusted such that the holders 103 of the transfer cylinder 101 may securely grasp the rear edge of the printing sheet Pa.

Since the phase adjustment of the reversing mechanism used to be carried out manually as described above, the mode switching from the single-side printing to the double-side printing or vice versa incurs a considerable loss of time, and further a number of defective prints are liable to occur due to mishandling in the switching operation.

SUMMARY OF THE INVENTION

The present invention has been accomplished in view of these problems inherent in the prior art.

Accordingly, it is a primary object of the present invention to provide a sheet transferring apparatus for the use in a press, in which the time required for the printing mode switching can be reduced, and also mishandling in the switching operation can be prevented.

It is another object of the present invention to provide a sheet transferring apparatus having an improved mechanism for registration of sheet reference position. In the improved mechanism, the registration of reference position in single-side printing can automatically and accurately be carried out to give printed matters with improved quality.

In order to attain the intended objects described above, a sheet transferring apparatus of the present invention is proposed. According to the present invention, a sheet is transferred between a plurality of printing units by a transfer cylinder which is rotatively provided between the adjacent units. This apparatus is for the use in an offset press which performs operations on a single surface and on both surfaces of the sheet selectively. The press has a power source for actuating the transfer cylinder, a first rotating member mechanically connected to the power source and a second rotating member mechanically connected to the transfer cylinder. The second rotating member is driven by the first rotating member. The press includes a phase adjusting mechanism for adjusting a phase between the first rotating member and the second rotating member and stopping means formed with the first and the second rotating members respectively, for stopping relative rotation between the first and the second rotating members.

DETAILED DESCRIPTION OF THE PREFERRED EMBODIMENT

Figure 1:
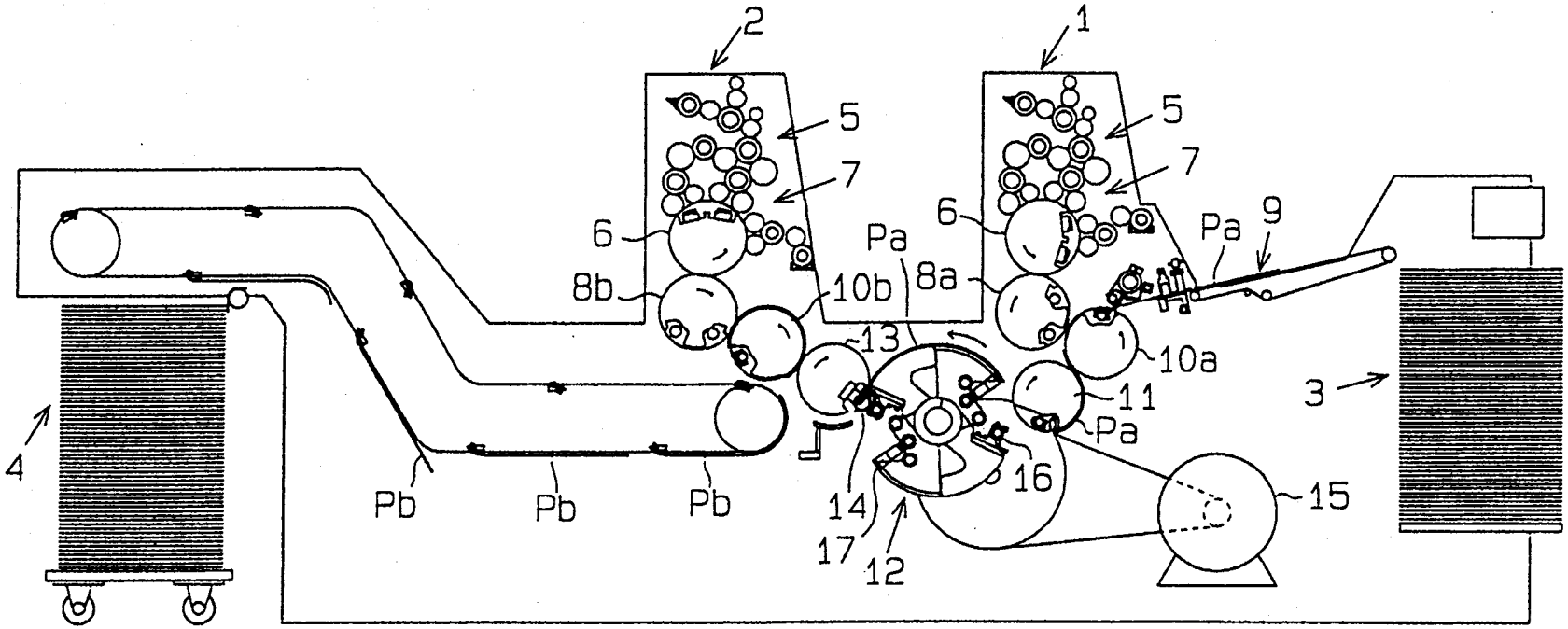
FIG. 1 is a front view showing the sheet reversing mechanism according to a single embodiment of the present invention.

An embodiment of the present invention will be described hereinafter referring to the drawings.

The offset press shown in FIG. 1 is provided with first and second printing units 1, 2. A feeder 3 is disposed adjacent to the first printing unit 1, while a delivery device 4 is disposed beside the second printing unit 2.

In each printing unit 1, 2, an ink is fed to a plate cylinder 6 via ink distribution rollers 5, and water is also fed to the plate cylinder 6 via water distribution rollers 7. The ink and water are mixed on the plate cylinder 6. The mixture is transferred to a blanket cylinder 8*a* or 8*b*. A printing sheet Pa is fed from the feeder 3 via a sheet feeder 9 to an impression cylinder 10*a*.

Figure 2:
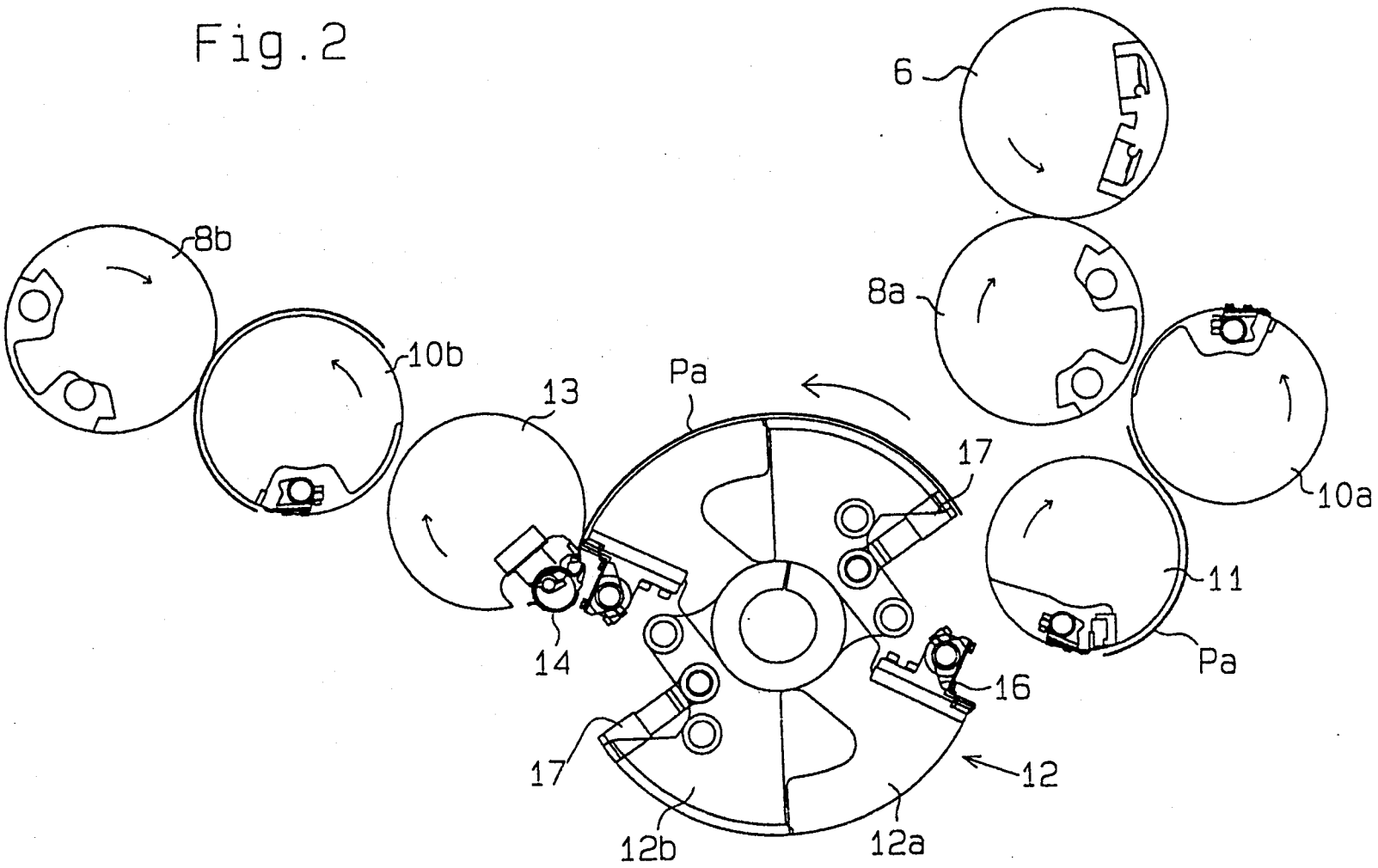
FIG. 2 is an enlarged front view showing the supply cylinder and its environment.

Motions of the respective cylinders in single-side two-color printing are shown in FIG. 2. A printing sheet Pa, which is retained on the circumference of a right impression cylinder 10*a*, is brought into contact with the circumference of the right blanket cylinder 8*a* to be subjected to a first color printing. The blanket cylinder 8*a* is revolved as the impression cylinder 10*a* revolves to apply printing on the entire surface of the sheet Pa. The thus printed sheet Pa is fed via a feed cylinder 11 to a supply cylinder 12 with the printed surface facing outward. The sheet Pa is then grasped at the front edge thereof by a plurality of holders 14 arranged in the axial direction of the transfer cylinder 13. The sheet Pa is fed to the transfer cylinder 13 with the printed surface facing inward. The sheet Pa is then retained on the left impression cylinder 10*b* with the printed surface facing outward again to be subjected to a second color printing by a left blanket cylinder 8*b*. These cylinders are revolved by a main motor 15.

Figure 3A:
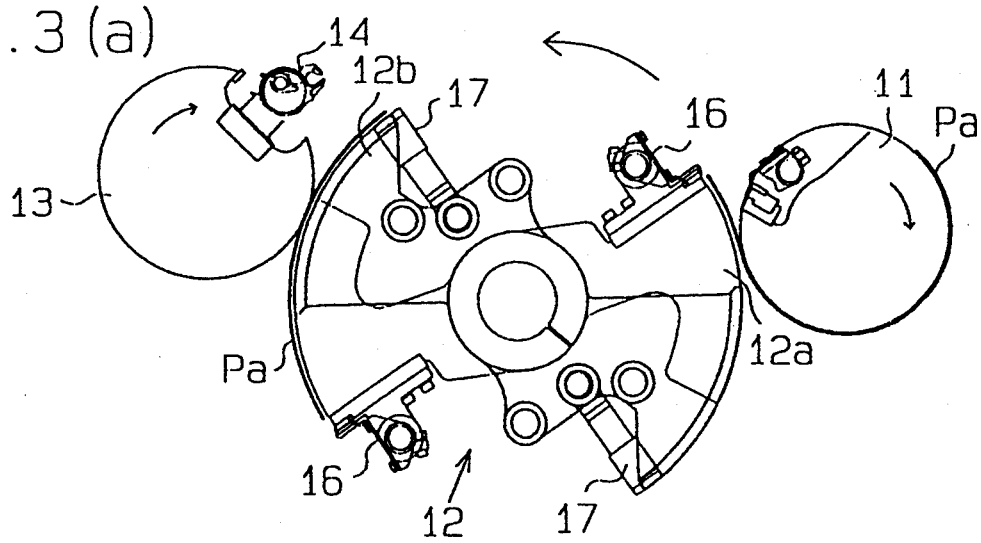
FIGS. 3 (*a*) through 3(*c*) sequentially show how a sheet is fed in the offset press of FIG. 1.
Figure 3B:
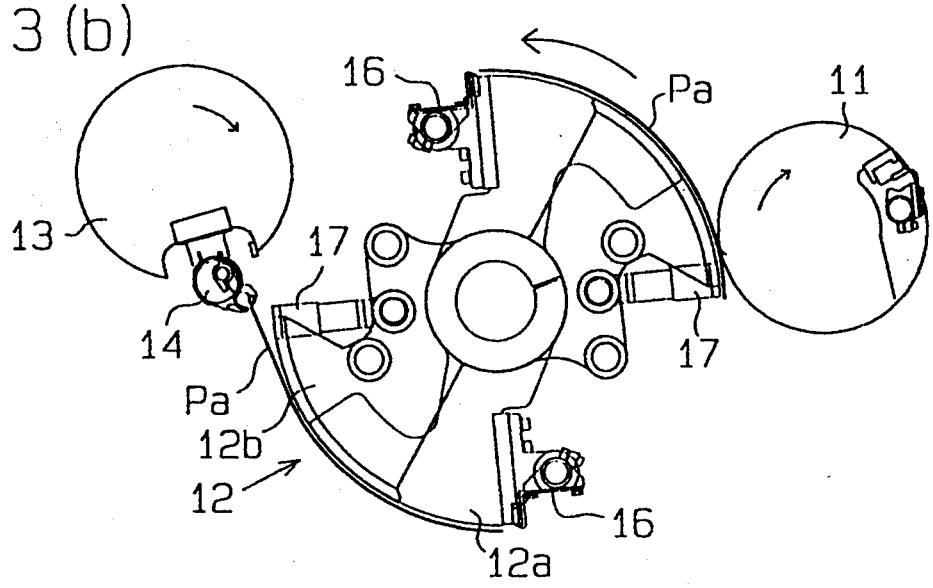
Figure 3C:
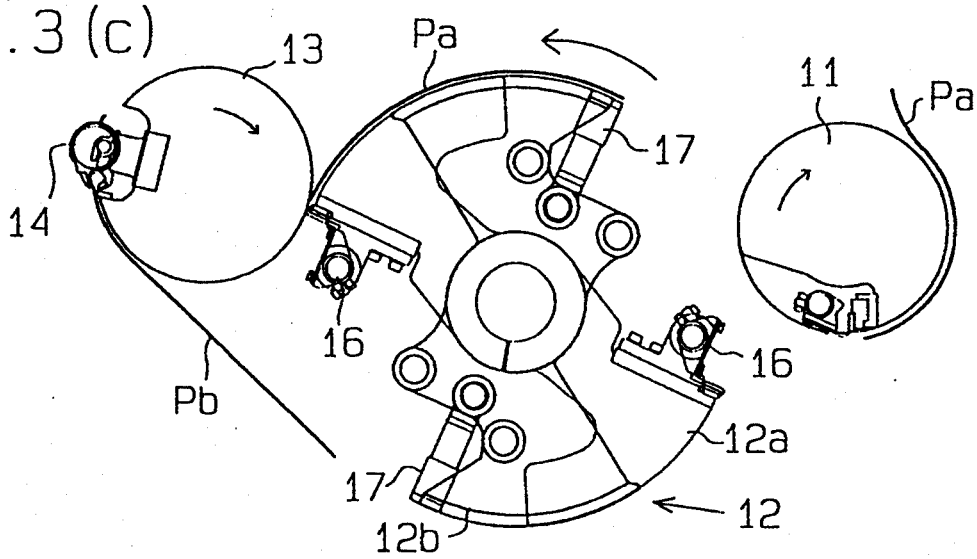

Meanwhile, in the case of double-side single-color printing, the printing sheet Pa is likewise printed on one surface thereof by the blanket cylinder 8*a* and then forwarded to the supply cylinder 12 via the feed cylinder 11 with the printed surface facing outward, as shown in FIG. 3(*a*). In this process, the front edge of the sheet Pa is grasped by grippers 16 of the supply cylinder 12 and retained on the circumference of the supply cylinder 12. After the supply cylinder 12 assuming such state is turned by a predetermined amount, the holders 14 grasp the rear edge of the sheet Pa. Subsequently, the holders 14 of the transfer cylinder 13 pivot counterclockwise so as not to crease the sheet Pa. As shown in FIG. 3(*b*), the rear edge of the sheet Pa is retained by the suction head 17 of the supply cylinder 12. The supply cylinder 12 consists of a front and a rear segments 12*a*, 12*b*. The segments 12*a*, 12*b* are designed to change the angle formed therebetween for accurately holding the rear edge of the sheet Pa by the suction head. After the front edge of the printing sheet Pa retained on the supply cylinder 12 passes the contact point between the cylinders 12 and 13, the rear edge of the sheet Pa is grasped by the holders 14 of the transfer cylinder 13. Further, as shown in FIG. 3(*c*), the sheet Pa is fed to the transfer cylinder 13 with the printed surface facing outward, and then retained on the left impression cylinder 106 shown in FIG. 1 with the printed surface facing inward to be subjected to printing on the rear surface by the left blanket cylinder 8*b*. The thus printed sheet Pb is forwarded to the delivery device 4 to complete printing.

Next, phase adjustment of the transfer cylinder 13 in the above-described switching between "single-side two-color printing" and "double-side single-color printing" will be described. While such adjustment is performed by a control unit shown in FIG. 8, the details of the control unit will be described later.

Figure 4:
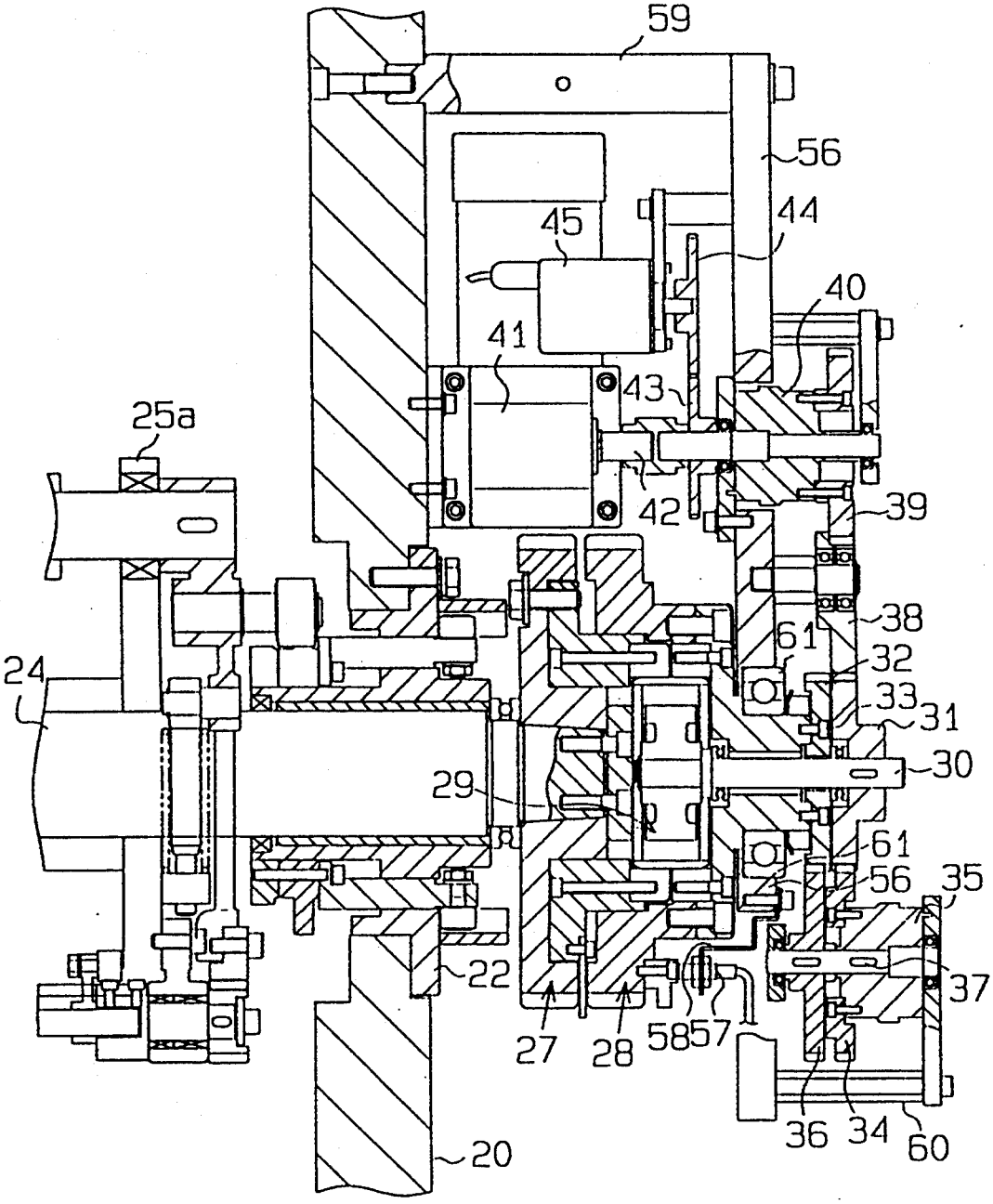
FIG. 4 is a cross-sectional view showing the gear phase adjusting section of the transfer cylinder.
Figure 5:
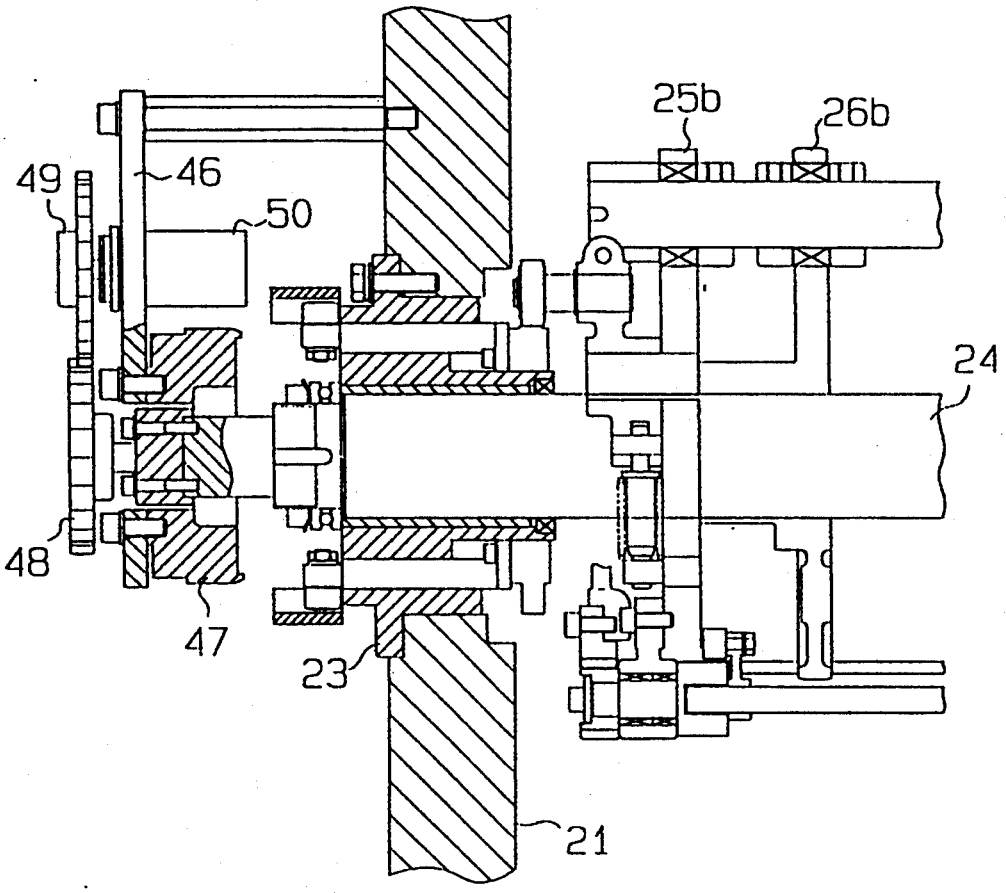
FIG. 5 is a cross-sectional view showing the phase adjusting section.

As shown in FIGS. 4 and 5, a main shaft 24 is rotatably supported between frames 20, 21 by way of a pair of bearings 22, 23. A pair of side plates 25*a*, 25*b* constitute the diaphragms of the transfer cylinder 13. The diaphragms is fixed on the main shaft 24 at the positions inner than the frames 25*a*, 25*b*, respectively. A plurality of guide pieces 26 are fixed onto the main shaft 24 at equal intervals between these side walls 25*a*, 25*b*. The circumferential surfaces of these guide pieces 26 guide the sheet Pa. A cylinder groove is defined in the respective guide pieces 26. Further, a support member 56 is secured on the outer side of the frame 20 by way of a bracket 59.

A driven gear 27 is provided at one end portion of the main shaft 24 to be rotatable integrally therewith. A drive gear 28 is attached to the driven gear 27 via Harmonic Differential Unit (a trademark; Harmonic Differential Co.) as a decelerator 29. The drive gear 28 is rotatably supported via a bearing 61 on the support member 56. The driving force of the main motor 15 is transmitted via a gear (not shown) to the drive gear 28. The driving force is further transmitted from the drive gear 28 through the driven gear 27 to the rollers 5 of the second printing unit 2.

The phase adjusting shaft 30 of the decelerator 29 protrudes from the outer surface of the support member 56. The phases of the gears 27, 28 are adjusted by turning the phase adjusting shaft 30. The adjusting shaft 30 is immobilized, so that transmission of the rotation of the drive gear 28 to the driven gear 27 is achieved at the ratio of 1:1.

A couple of gears 31, 32 is secured on the outer end portion of the adjusting shaft 30. The gear 31 is fixed to the adjusting shaft 30 at an outer position. The gear 32 is arranged next to the gear 31 and fixed by means of bolts 33 on the drive gear 28.

A locking electromagnetic clutch 35 is secured on the outer surface of the support member 56 by way of a bracket 60. A gear 36 is fixed to the shaft 37 of the clutch 35 together with a gear 34. The gear 34 is engaged with the gear 31 and connected to the shaft 37 of the gear 36 by way of the clutch 35. The gear 36 is engaged with the gear 32 so as to prevent relative rotation between the gear 34 and the gear 36 while the clutch 35 is actuated. The adjusting shaft 30 is retained as locked against the drive gear 28.

A phase control motor 41 drives the gear 31 connected to a shaft 42 of the motor 41 by way of gears 38, 39 and an electromagnetic clutch 40. A gear 43 is fixed onto the shaft 42. An encoder 45 is fixed to the member 56. A gear 44 mounted on the shaft of the encoder 45 is engaged with the gear 43. The revolution of the motor 41 is detected by this encoder 45. The phases of two gear 27, 28 are detected in accordance with the revolution of the motor 41.

An electromagnetic brake 47 is secured to a bracket 46 extending from the frame 21, as illustrated in FIG. 5. The brake 47 functions as the braking means for the transfer cylinder. The electromagnetic brake 47 is fitted on the main shaft 24 for holding the shaft 24 unrotatable upon actuation of the brake 47. A timing detector (resolver) 50 is mounted on the bracket 46. The resolver 50 has a gear 49 and detects the actuating timing of the second unit. The main shaft 24 is connected at its end to the timing detector 50 by way of a gear 48 mating the gear 49. The reference position of the second unit 2 is detected by the timing detector 50.

Figure 6:
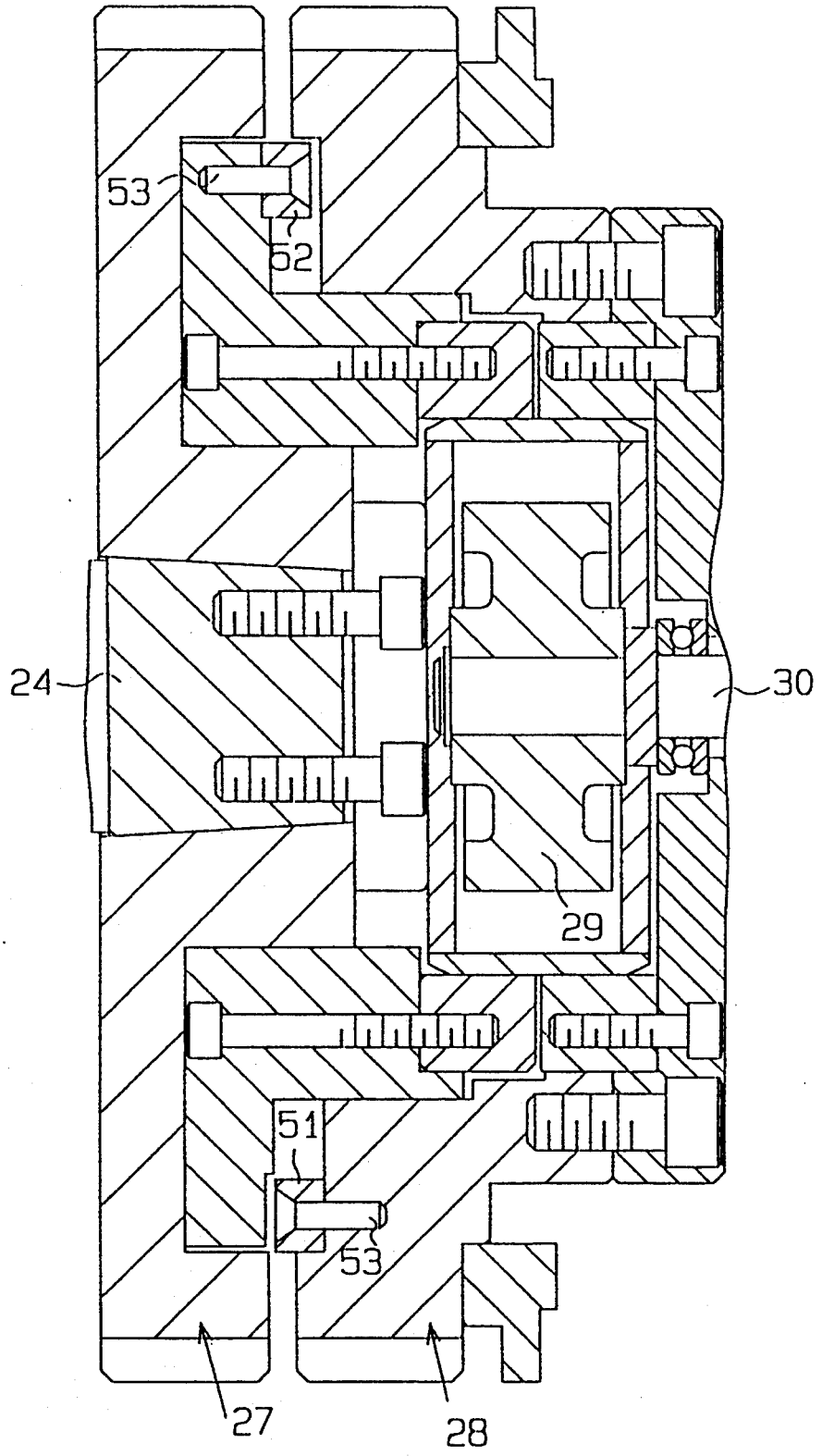
FIG. 6 is an enlarged cross-sectional view showing the drive gear and the driven gear illustrated in FIG. 4.
Figure 7:
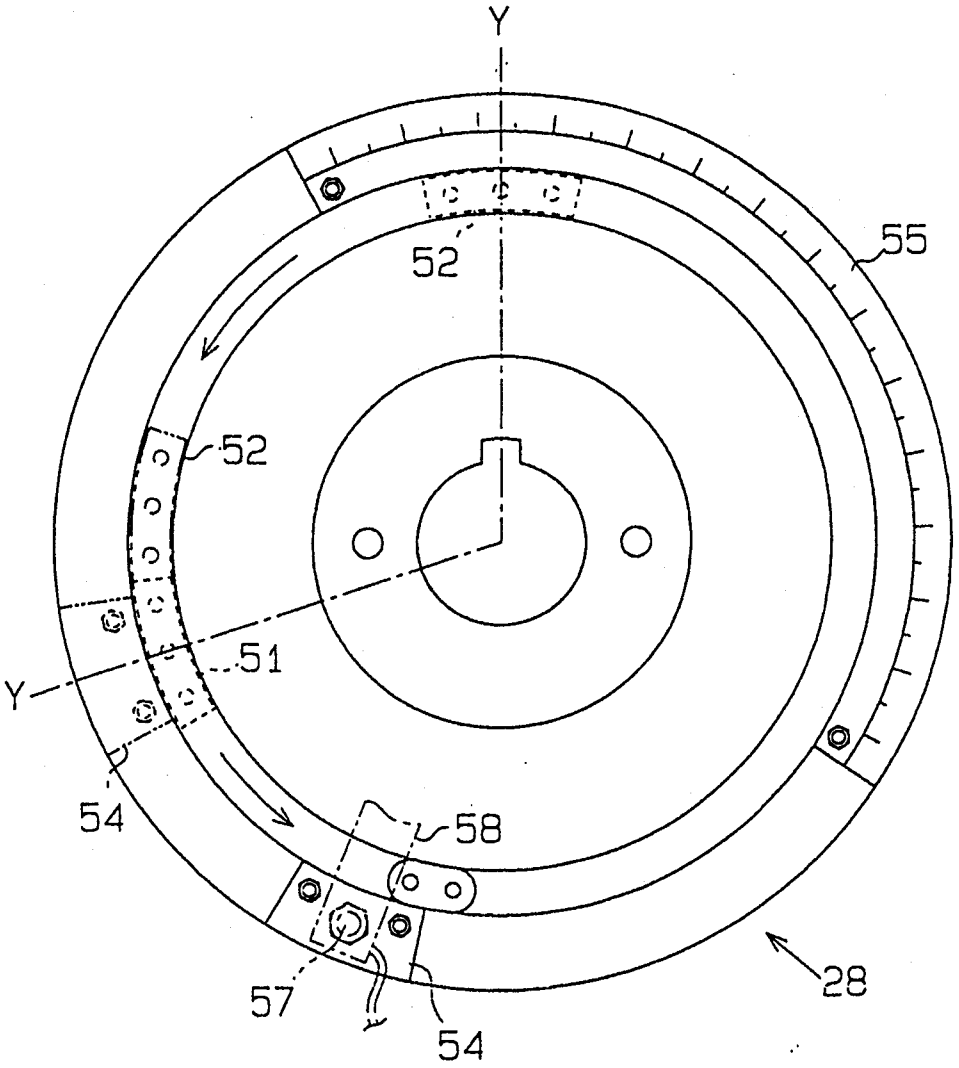
FIG. 7 is an enlarged view showing the scale of the drive gear illustrated in FIG. 4.

FIG. 6 shows a cross section taken along Y—Y line in FIG. 7. The drive gear 28 and the driven gear 27 have stoppers 51, 52, as the reference position registering mechanism, fastened by bolts 53, respectively. The driven gear 27 is fixed to the main shaft 24. The stoppers 51, 52 are arranged to be equally spaced from the axis of the main shaft 24 in such a way that the end faces of the stoppers 51, 52 may be abutted against each other at the reference position when the drive gear 28 is turned by the motor 41.

Since the stoppers 51, 52 are provided on the opposing surfaces of these gears 27, 28, the reference position registering mechanism can be constructed compactly. This compact mechanism can be disposed in the press without interfering with other members. Further, as shown in FIG. 7, the stoppers 51, 52 are abutted against each other at the reference position (the stopper 52 as indicated by a fantom line). Accordingly, and when the drive gear 28 is turned, the driven gear 27 is pushed by the stoppers 51,52 to turn together with the drive gear 28.

A scale 54 for "single-side printing" and a paper size scale 55 for "double-side printing" are secured on the other surface of the gear 28. Two scales 54, 55 have an arc shape and extend along the periphery of the gear 28 As shown in FIGS. 4 and 7, a reference position sensor 57 is attached via a bracket 58 to a free end of the support member 56 extended from the frame 20. The sensor 57 detects the reference position of the gears 27, 28, where the abutment of two stoppers 51, 52 is taken place. While a proximity sensor is employed as the reference position sensor 57 in the preferred embodiment, other sensors can be also employed.

The sensor 57 is disposed to oppose to the center or therearound of the for the "single-side printing" scale 54 when the drive gear 28 is at the reference position. When the drive gear 28 is turned to reset to the reference position from the "double-side printing position", the sensor 57 detects the "single-side printing" scale 54 and outputs a signal immediately before the gear 28 reaches the reference position.

Figure 8:
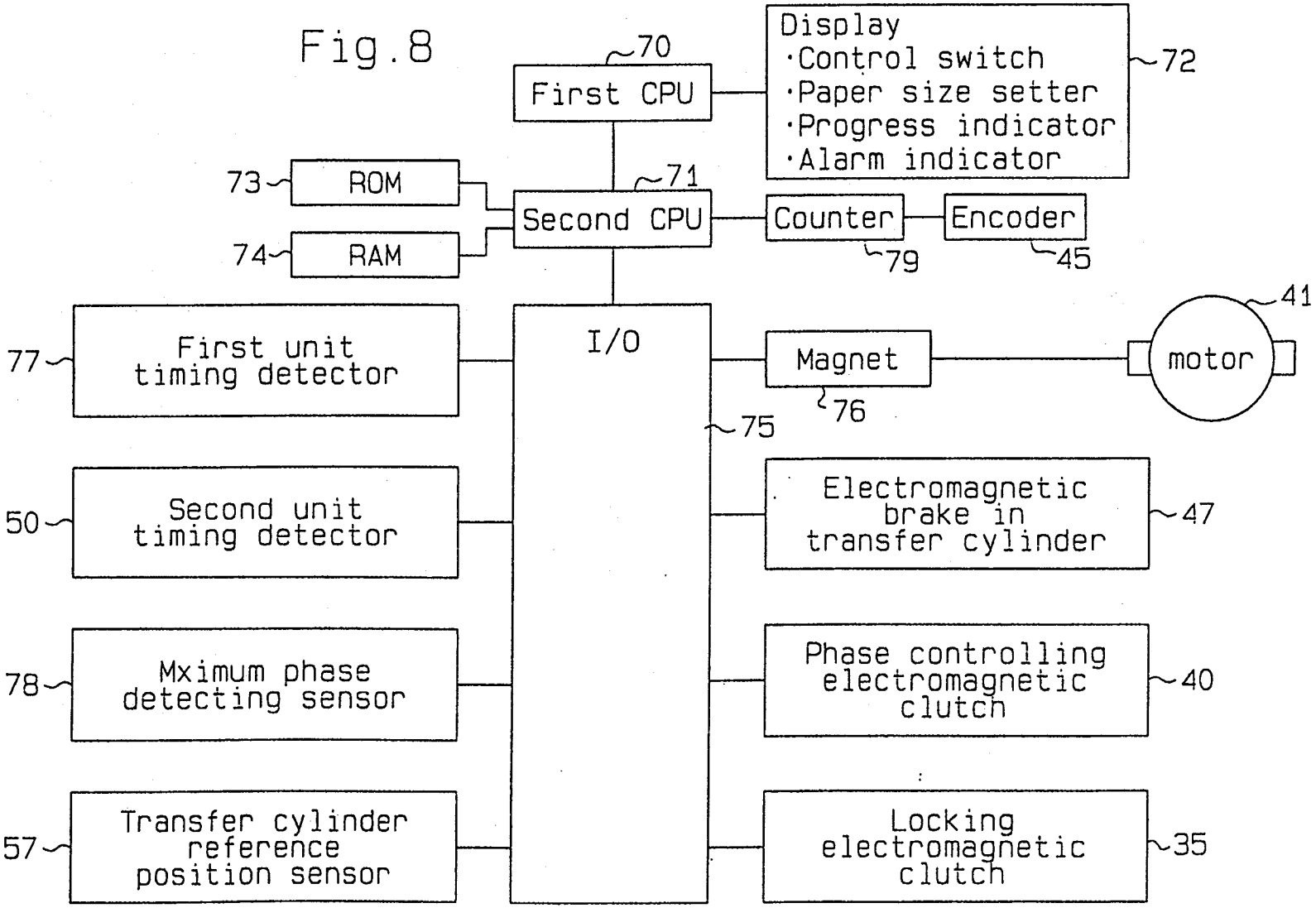
FIG. 8 shows a block diagram of a part in the electric system used in the offset press.

As illustrated in FIG. 8, the control unit which performs mode switching and phase adjustment, is provided with two CPU (central processing units) 70, 71. A display unit 72 is connected to the first CPU 70 for display. The display unit 72 is provided with control switches or an input section including sheet size setter etc.

The control switches are arranged in the form of a touch panel. The smallest necessary number of switches on the screen is selected and operated. The sheet size setter consists of ten keys provided on the display unit 72 and is used for inputting data indicative of the longitudinal size of the sheet Pa. Further, the display unit 72 has a function of a real-time-display relating to the progress of operation. In addition the display unit 72 has an alarm function for displaying malfunction such as failure.

The second CPU 71 is for use of controlling the electric members in the press. To the CPU 71 are connected a ROM (read only memory) 73 and a RAM (random access memory) 74. A program for controlling the motions of the press is stored in the ROM 73. The RAM 74 stores temporarily data in the course of computing operation etc. Further, an input/output unit (I/O) 75 is connected to the second CPU 71.

The phase control motor 41 is connected to the I/O unit 75 by way of a magnet 76, so that the revolution direction of the motor 41 is controlled. A first unit timing detector 77 and a transfer cylinder maximum position sensor 78 are connected to the I/O unit 75. The maximum position sensor 78 detects the transfer cylinder 13 to be at the maximum phase position where the phase between the reference position and current position of the cylinder 13 is maximum. Meanwhile, the electromagnetic brake 47, the electromagnetic clutch 40 and the locking electromagnetic clutch 35 are connected to the I/O unit 75. The encoder 45 is also connected to the second CPU 71 via a counter 79.

In order to adjust the phase between two gears 27, 28 through the motor 41 by CPU 71, a signal is transmitted from the CPU 71 via the I/O unit 75 to the brake 47 and the clutch 40. More specifically, the main shaft 24 is free from locking of the brake 47. The clutch 40 allows the motor shaft 42 to mate the gear 39. Subsequently, a signal is transmitted from the CPU 71 via the I/O unit 75 to the motor 41.

The revolution of the motor 41 is transmitted via the gears 39, 38, 31 to the adjusting shaft 30. Since the electromagnetic clutch 35 is deactuated at this moment, the gears 31, 32 can rotate relative to each other. In accordance with this rotation, the phase of two gears 27, 28 are adjusted. The revolution of the motor 41 is constantly detected by the encoder 45, and the signals from the encoder 45 are transmitted via the counter 79 to the CPU 71.

When the phase adjustment between two gears 27, 28 is not carried out, the clutch 40 is deactuated and the clutch 35 is actuated. If the main motor 15 is revolved in this state, the adjusting shaft 30 of the decelerator 29 receives a force to be rotated with respect to the drive gear 28 due to the load applied to the driven gear 27. However, since the electromagnetic clutch 35 is actuated, relative rotation of the gears 31, 32 is inhibited thereby, so that the shaft 30 is kept immobilized on the gear 28. In other words, the drive gear 28 is immobilized to the driven gear 27 to prevent induction of out-of-phase due to the load. It should be noted here that the electromagnetic clutch 40 is deactuated, so that the extra load is not applied to the rotation of the gear 31 but the gears 38, 39 engaged with the gear 31 merely rotate.

In the thus constituted offset press, phase adjustment of the gears 27, 28, namely transfer cylinder 13 will be described referring to the flow chart. The proceeding of the flow chart is subject to the control of the second CPU 71 in accordance with the program in the ROM 73.

Figure 9:
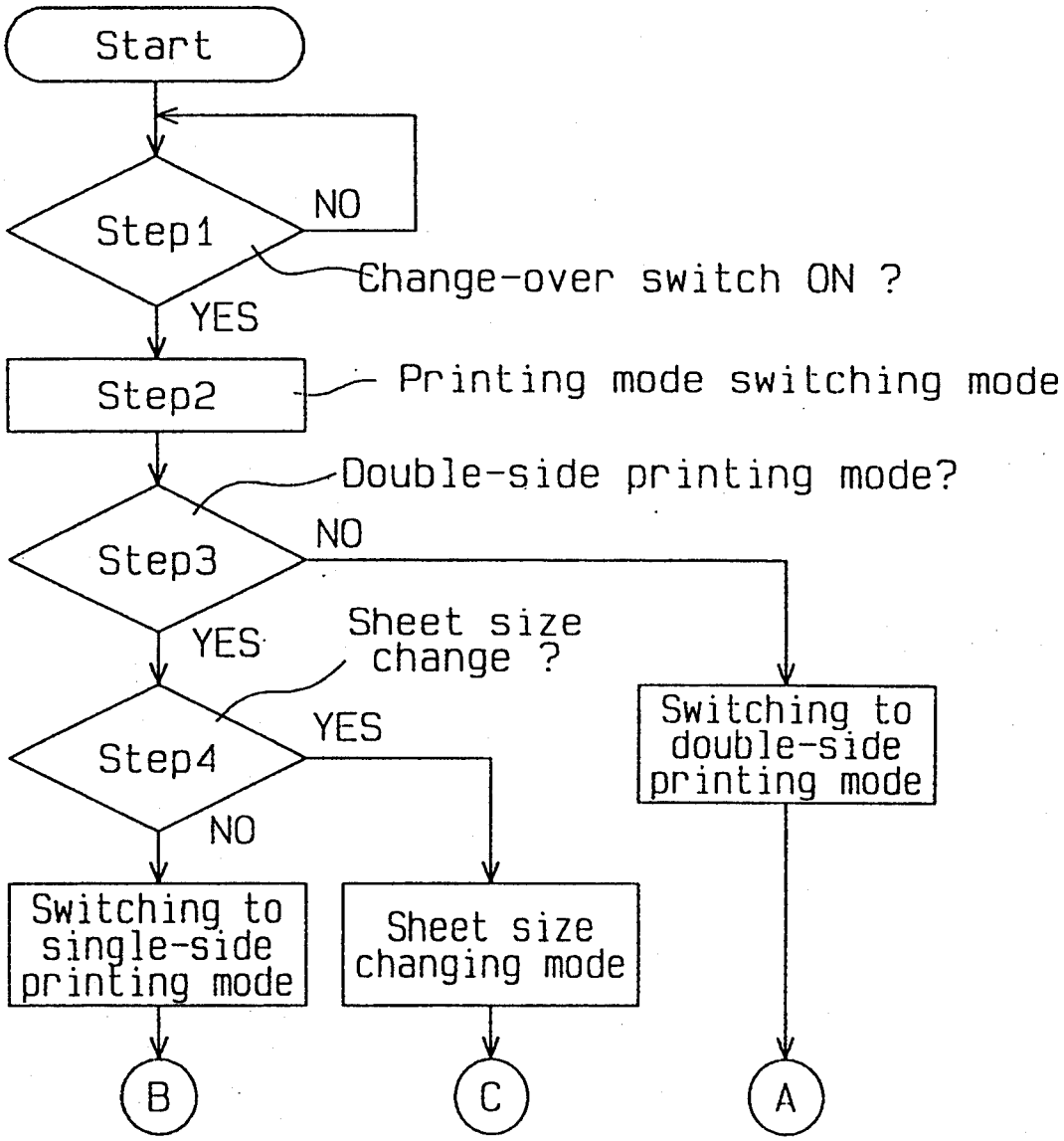
FIG. 9 is a flow chart explaining the beginning part of the mode switching program.

When the control switch for mode switching is turned on (Step 1) as shown in FIG. 9, the CPU 71 calls a program for switching the printing mode (Step 2). The CPU 71 determines the current printing mode (Step 3). Namely, when the current mode of the press is "the single-side two-color printing mode", the mode is switched to the "double-side single-color printing mode" (A). When the current mode is the "double-side single-color printing mode", the CPU 71 further determines whether the sheet size should be changed (Step 4). When the sheet size is to be changed, the mode is switched to the sheet size change mode (B), whereas when the sheet size is not to be changed, the "double-side single-color printing mode" is changed to the "single-side two-color printing mode" (C).

Figure 10:
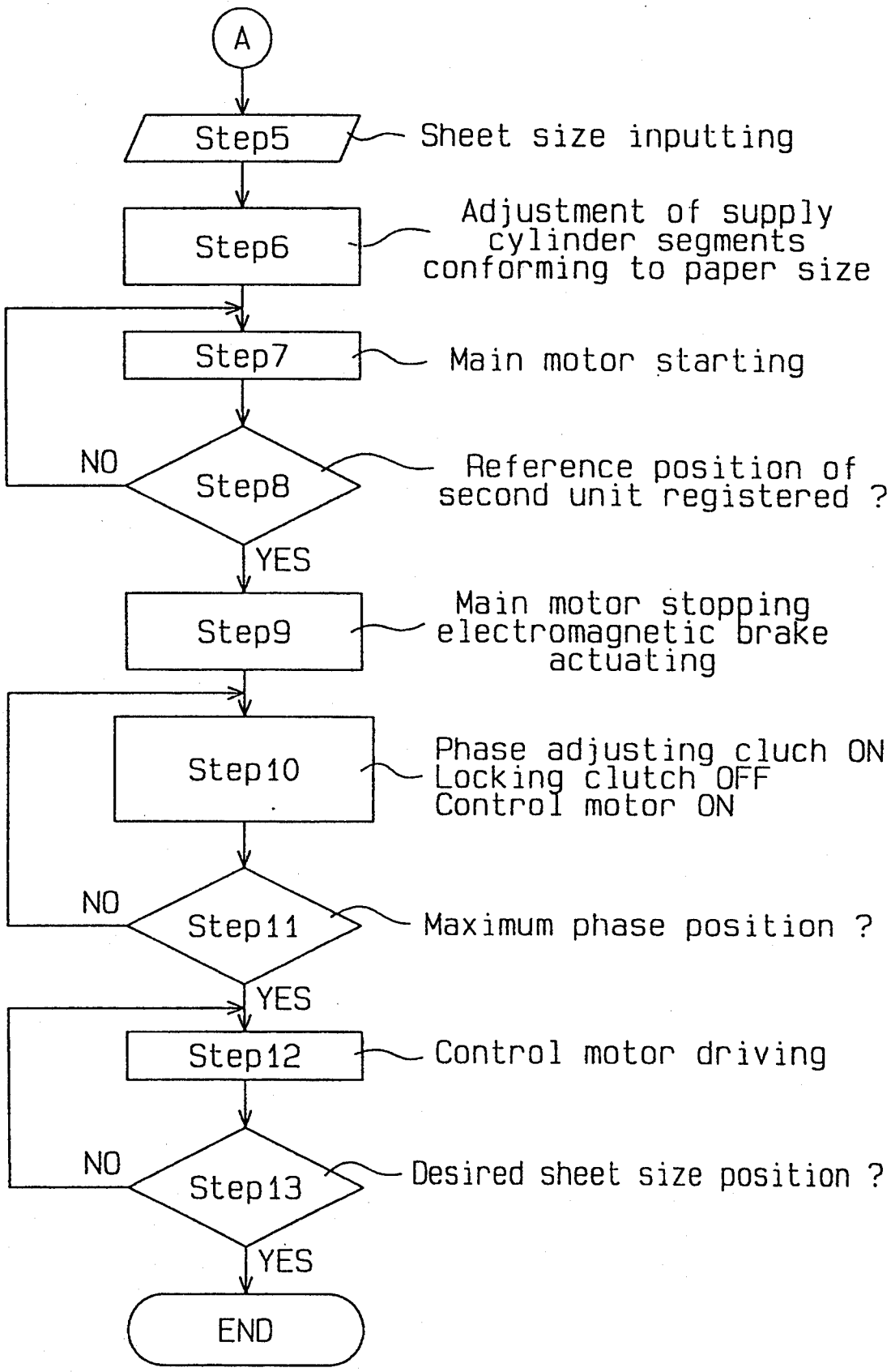
FIG. 10 is a flow chart explaining the program for switching "single-side printing" mode to "double-side printing" mode.

Phase adjustment of the transfer cylinder 13 is performed when the "single-side two-color printing mode" is changed to the "double-side single-color printing mode". This adjustment process represented by (A) will be described referring to the flow chart shown in FIG. 10.

When the data indicative of the sheet size is input using the ten keys of the display unit 72 (Step 5), the angle between the front and rear segments 12*a*, 12*b* of the supply cylinder 12 is adjusted in accordance with the sheet size (Step 6). The main motor 15 is then driven (Step 7). The transfer cylinder 13 is turned to a predetermined position based on the signal of the second unit timing detector 50 (Step 8). The electromagnetic brake 47 is actuated upon stopping of the main motor 15 to lock the transfer cylinder 13 (Step 9). In this state, the electromagnetic clutch 40 for adjusting phase is deactuated and the other electromagnetic clutch 35 for locking is actuated. Subsequently, the clutch 40 is actuated and the clutch 35 is deactuated. Subsequently, the motor 41 is driven (Step 10). The driving operation of the motor 41 opens the transfer cylinder 13 to the maximum phase position where the position sensor 78 outputs a signal. The transfer cylinder 13 is kept in such state (Step 11).

Further, the phase control motor 41 is driven (Step 12). The phase of the transfer cylinder 13 is adjusted to conform to the desired sheet size based on the signal transmitted from the encoder 45 (Step 13). Since the electromagnetic brake 47 is actuated to lock the transfer cylinder 13, the rotation of the respective cylinders in the second printing unit is prevented, enabling accurate phase adjustment of the transfer cylinder 13.

Figure 11:
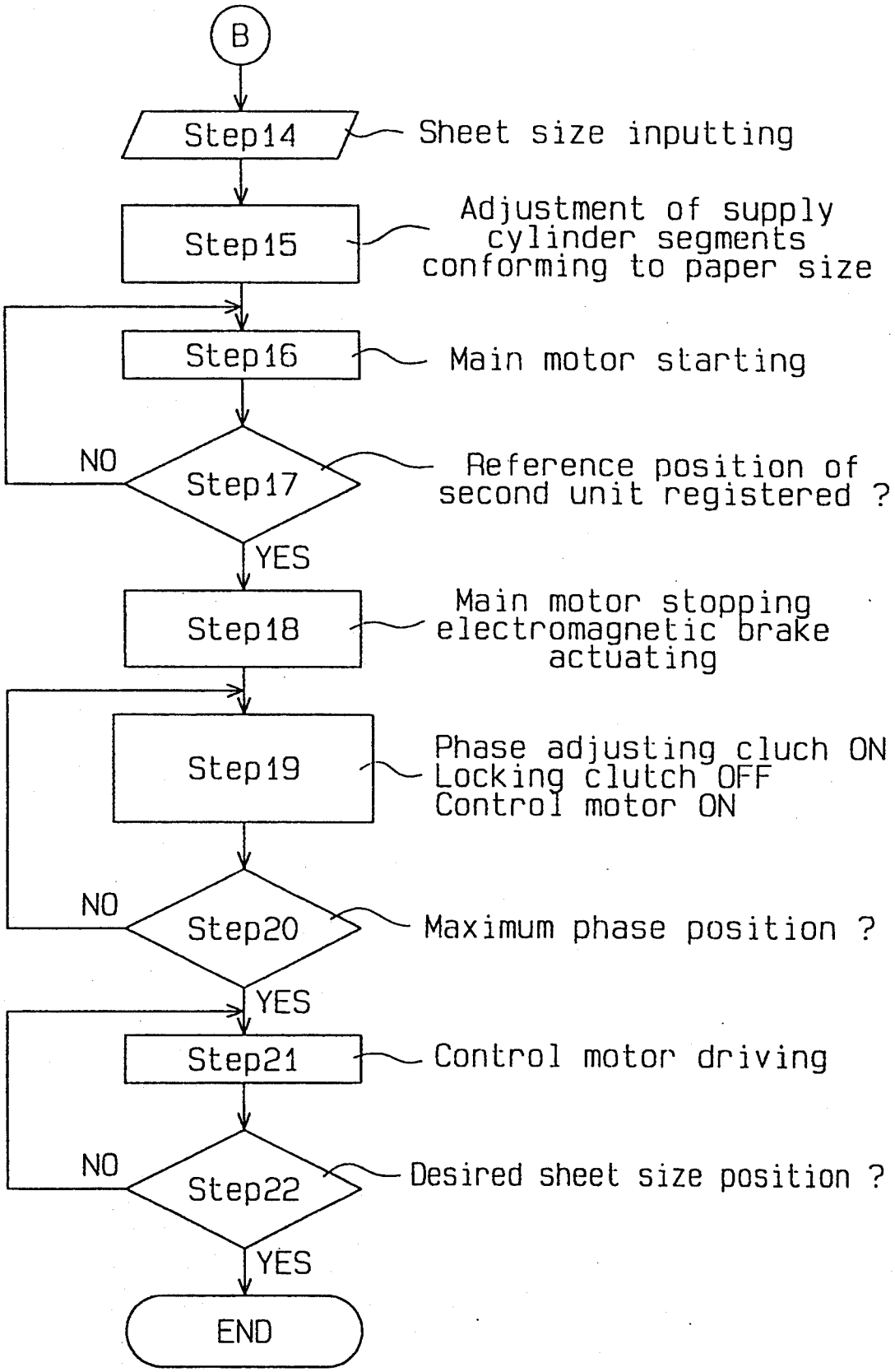
FIG. 11 is a flow chart explaining the program for changing the printing sheet size.

Next, phase adjustment of the transfer cylinder 13 in the sheet size changing mode (B) will be described referring to the flow chart of FIG. 11.

When the data representing of the sheet size is input using the ten keys of the display unit 72 (Step 14), the angle between the front and rear segments 12*a*, 12*b* of the supply cylinder 12 is adjusted so as to conform to the sheet size, and these segments 12*a*, 12*b* are locked by a segment lock pin which is not shown (Step 15). The main motor 15 is then started (Step 16). When the transfer cylinder 13 is turned to the reference position of the second unit based on the signals from the timing detector 50 (Step 17), the brake 47 is actuated upon stopping of the main motor 15 to lock the transfer cylinder 13 (Step 18).

Subsequently, the clutch 40 for adjusting the phase is actuated, and the clutch 35 for locking operation is deactuated. After the phase control motor 41 is driven (step 19), the transfer cylinder 13 is opened to the maximum phase position. According to the signal transmitted from the position sensor 78, the CPU 71 determines the cylinder 13 is fully opened and keep the cylinder 13 is in this state (Step 20). Further, the control motor 41 is driven (Step 21). Therefore, the phase of the cylinder 13 is adjusted to conform to the desired sheet size in accordance with the signal from the encoder 45 (Step 22).

Figure 12:
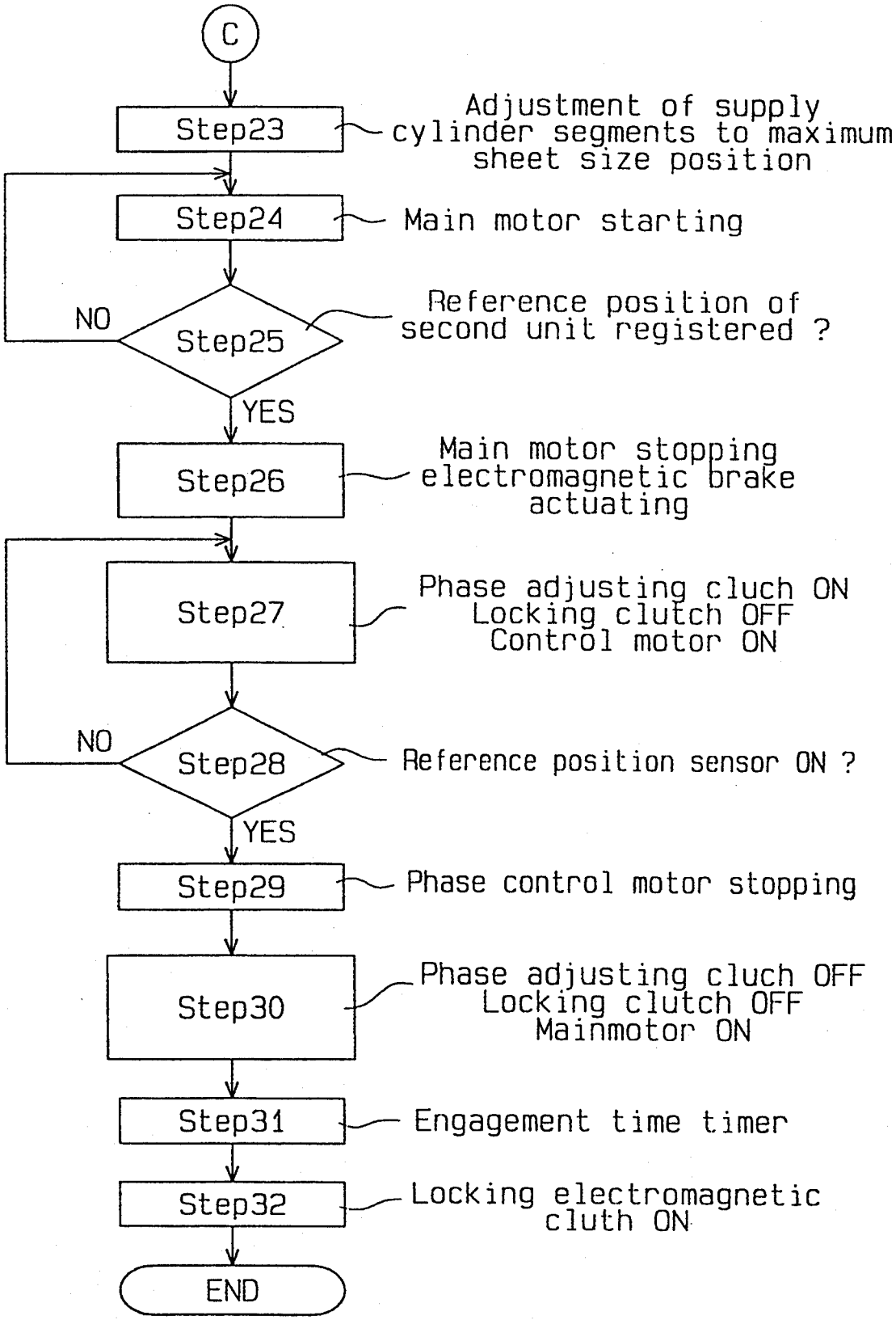
FIG. 12 is a flow chart explaining the program for switching "double-side printing" mode to "single-side printing" mode.
Figure 13A:
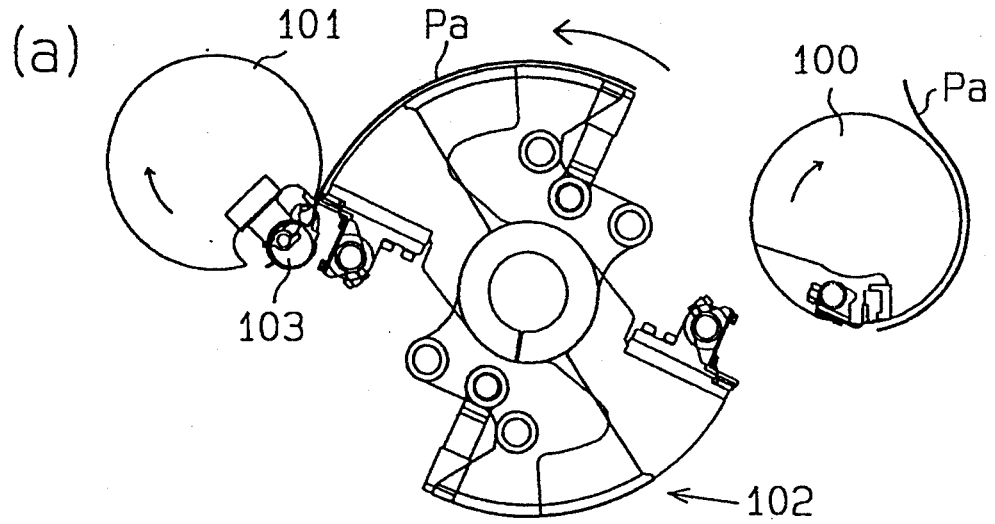
Fig.13(a) (Prior Art)
FIGS. 13(*a*)–13(*b*) are front views showing the conventional sheet transferring apparatus for the offset press.
Figure 13B:
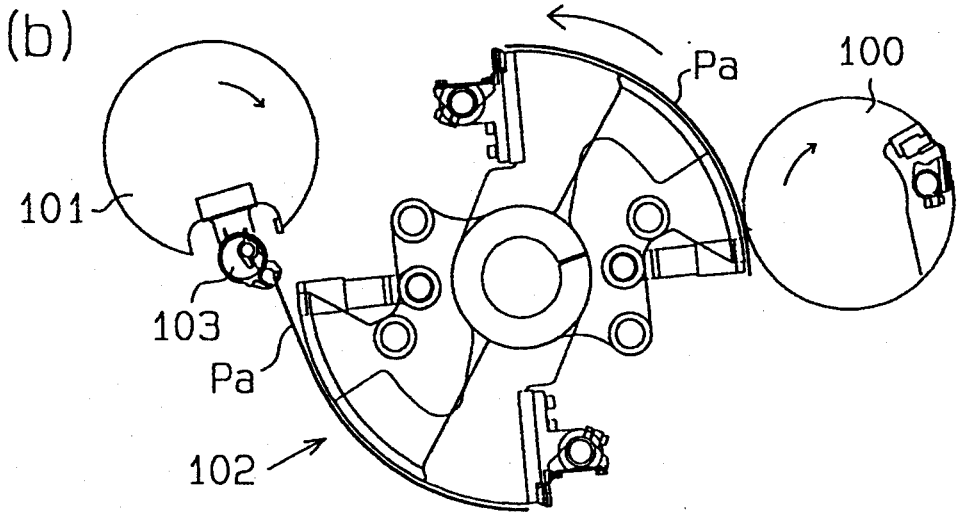
Fig.13(b) (Prior Art)
Figure 14:
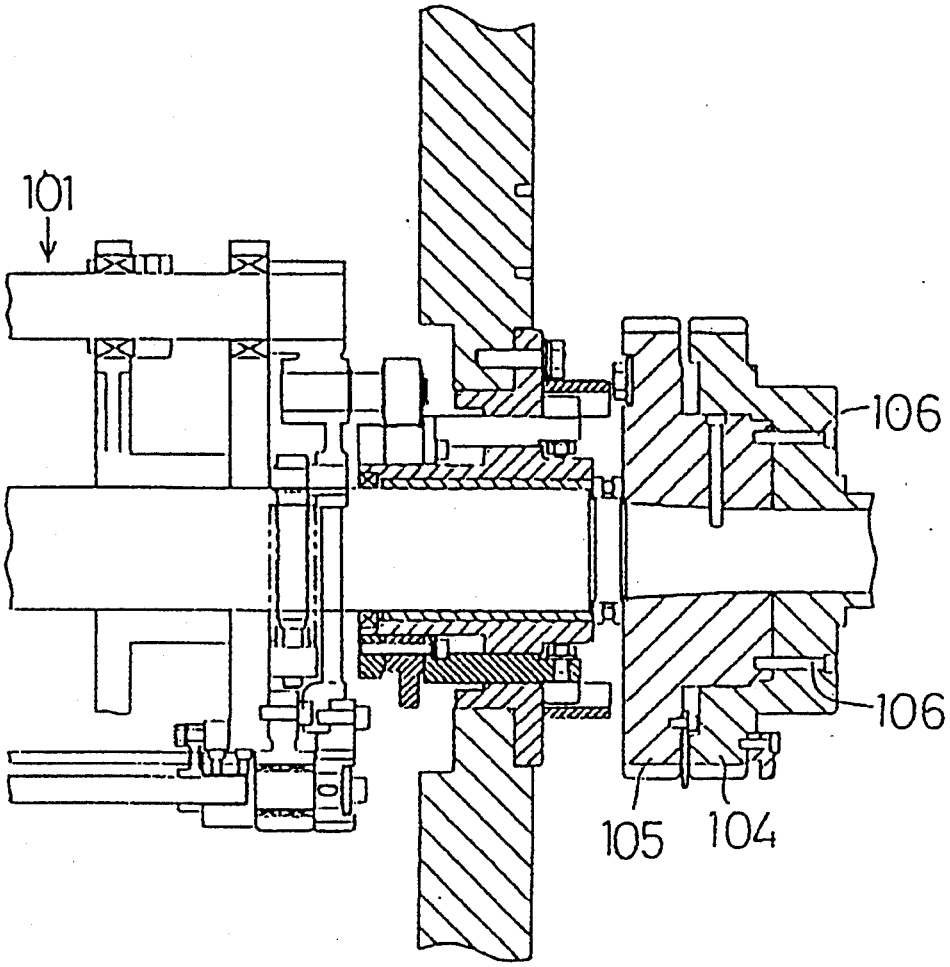
FIG. 14 (PRIOR ART)
FIG. 14 is a cross-sectional view showing the major part of the gear phase adjusting section according to the conventional sheet transferring apparatus.

Phase adjustment of the transfer cylinder 13 when the "double-side single-color printing mode" is changed to the "single-side two-color printing" (C) will be hereinafter explained referring to the flow chart of FIG. 12. The angle between the front and rear segments 12*a*, 12*b* of the supply cylinder 12 is adjusted to the maximum position to conform the maximum sheet size (Step 23). After completion of the adjustment in the supply cylinder 12, the main motor 15 is driven (Step 24). When the transfer cylinder 13 is turned to the reference position of the second unit (Step 25), the brake 47 is actuated upon stopping of the main motor 15 to lock the transfer cylinder 13 (Step 26). In this state, the clutch 40 for adjusting phase is deactuated, and the other clutch 35 for locking operation is actuated.

At the phase adjustment, the electromagnetic clutch 40 is first actuated, and the locking electromagnetic clutch 35 is deactuated. When the control motor 41 is driven (Step 27), the transfer cylinder 13 is turned close to the reference position in "single-side printing". When the reference position sensor 57 transmits a ON signal (Step 28), the motor 41 is stopped (Step 29).

Subsequently, following the deactuation of the phase-adjusting clutch 40 and the brake 47 for unlocking the transfer cylinder 13, the main motor 15 is slowly revolved (Step 30). This causes the drive gear 28 to start to rotate alone. The stopper 51 of the drive gear 28 abuts against the stopper 52 of the driven gear 27, resulting in the driven gear 27 to rotate together with the drive gear 28. Accordingly, the transfer cylinder 13 begins to rotate. After the transfer cylinder 13 is rotated for a predetermined time (Step 31), the locking clutch 35 is actuated to immobilize the phase between the gears 27, 28 (step 32). The state where the stopper 51 of the gear 28 abuts against the stopper 52 of the gear 27 corresponds to the reference position in "single-side printing", and the switching operation is completed by the series of procedures described above.

As described above, the two stoppers 51, 52 abut against each other at the reference position in the offset press according to the embodiment. Therefore, the registration accuracy of the reference position can be improved.

Further, following the stop motion of the drive gear 28 prior to reaching the reference position, the drive gear 28 is turned slowly. This may weaken the impact when the stoppers 51, 52 abut against each other, preventing reduction in deformation of the stoppers 51, 52. Accordingly, the accurate registration of the reference position may be carried out.

It should be understood that the present invention is not limited to the embodiment described herein, but the constitution thereof may partly be modified without departing from the spirit of the invention. For instance:

(1) While an electromagnetic brake 47 is employed for applying a braking force so as to stop rotation of the transfer cylinder, a recess may be formed on the transfer cylinder in which a pin is inserted from the frame side instead of using the electromagnetic brake.

(2) While the stoppers 51,52 are fastened with bolts in this embodiment, they may be formed integrally with the drive gear and the driven gear respectively.

What is claimed is:

1. A sheet transferring apparatus for transferring a sheet between a plurality of printing units including a transfer cylinder rotatively provided between the adjacent units, wherein printing operations on a single surface and on both surfaces of the sheet are selectively performed, said apparatus comprising:

a power source for actuating the transfer cylinder;

a first rotating member mechanically connected to the power source;

a second rotating member mechanically connected to the transfer cylinder, said second rotating member being arranged to be driven by the first rotating member;

phase adjusting means for adjusting a phase between the first rotating member and the second rotating member; and stopping means formed with the first and the second rotating members respectively, for stopping relative rotation between the first and the second rotating members.

2. An apparatus as set forth in claim 1, wherein the first rotating member includes a drive gear; and the second rotating member includes a driven gear mating with the drive gear.

3. An apparatus as set forth in claim 2, wherein said phase adjusting means includes:

a motor;

a decelerator operably connected to the drive and driven gears; and a rotary shaft mounted on the decelerator for connecting the decelerator to the motor, said rotary shaft being arranged to adjust the phase between the rotating members when the rotary shaft is rotated by the motor.

4. An apparatus as set forth in claim 3, wherein said drive gear is set at a reference position corresponding to a predetermined phase between the drive gear and the driven gear, when printing mode is changed from the both sides printing mode to the single side printing mode.

5. An apparatus as set forth in claim 4, wherein said stopping means includes a first stopper formed with the drive gear and a second stopper formed with the driven gear, said first and second stoppers being arranged to abut against each other to stop relative rotation between said drive gear and said driven gear.

6. An apparatus as set forth in claim 5, wherein said first stopper and said second stopper being arranged to abut against each other when said drive gear rotates to the reference position.

7. An apparatus as set forth in claim 1 further comprising:

means for detecting a relative position of said first rotating member and said second rotating member; and means for protecting said stopping means, wherein said protecting means stops the turning movement of said first rotating member before said stopping means abut against each other and restarts the turning movement of said first rotating member at a low speed to allow said stopping means to abut against each other.

8. An offset press having a plurality of printing units wherein printing operations on a single surface and on both surfaces of a printing sheet are selectively performed when the sheet is transferred from the preceding printing unit to the next printing unit by a transfer cylinder rotatively provided between the adjacent units, said press comprising:

a power source for actuating the transfer cylinder;

a first rotating member mechanically connected to the power source;

a second rotating member mechanically connected to the transfer cylinder, said second rotating member being arranged to be driven by the first rotating member;

phase adjusting means for adjusting a phase between the first rotating member and the second rotating member;

stopping means formed with the first and the second rotating members respectively, for stopping relative rotation between the first and the second rotating members;

means for detecting a relative position of said first rotating member and said second rotating member; and means for protecting said stopping means, wherein said protecting means stops the turning movement of said first rotating member before said stopping means abut against each other and restarts the turning movement of said first rotating member at a low speed to allow said stopping means to abut against each other.

9. An apparatus as set forth in claim 8, wherein the first rotating member includes a drive gear; and the second rotating member includes a driven gear mating with the drive gear.

10. An apparatus as set forth in claim 9, wherein said phase adjusting means includes:

a motor;

a decelerator operably connected to the drive and driven gears; and a rotary shaft mounted on the decelerator for connecting the decelerator to the motor, said rotary shaft being arranged to adjust the phase between the rotating members when the rotary shaft is rotated by the motor.

11. An apparatus as set forth in claim 10, wherein said drive gear is set at a reference position corresponding to a predetermined phase between the drive gear and the driven gear, when printing mode is changed from the both sides printing mode to the single side printing mode.

12. An apparatus as set forth in claim 11, wherein said stopping means includes a first stopper formed with the drive gear and a second stopper formed with the driven gear, said first and second stoppers being arranged to abut against each other to stop relative rotation between said drive gear and said driven gear.

13. An apparatus as set forth in claim 12, wherein said first stopper and said second stopper being arranged to abut against each other when said drive gear rotates to the reference position.

14. An apparatus as set forth in claim 13, wherein said detecting means includes a sensor for outputting a signal when the position of the drive gear is close to the reference position.

15. An apparatus as set forth in claim 14, wherein said protecting means includes a central processing unit for braking the drive gear in accordance the signal from the sensor.

16. An offset press having a plurality of printing units wherein printing operations on a single surface and on both surfaces of a printing sheet are selectively performed when the sheet is transferred from the preceding printing unit to the next printing unit by a transfer cylinder rotatively provided between the adjacent units, said press comprising:

a first motor for actuating the transfer cylinder;

a drive gear mechanically connected to the motor, a driven gear mechanically connected to the transfer cylinder, said driven gear mating with the drive gear, and said drive gear being set at a reference position corresponding to a predetermined phase between the drive gear and the driven gear, when printing mode is changed from the both sides printing mode to the single side printing mode;

a second motor;

a decelerator operably connected to the drive and driven gears;

a rotary shaft mounted on the decelerator for connecting the decelerator to the second motor, said rotary shaft being arranged to adjust the phase between the drive and driven gears when the rotary shaft is rotated by the second motor;

a first stopper formed with the drive gear;

a second stopper formed with the driven gear, said first and second stoppers being arranged to abut against each other to stop relative rotation between said drive gear and said driven gear;

a sensor for detecting a position of the drive gear and outputting a signal, when the detected position is close to the reference position; and a central processing unit for braking the drive gear in accordance with the signal from the sensor and restart the drive gear at a low speed.

* * * * *